US010279360B2

(12) United States Patent
Patel

(10) Patent No.: US 10,279,360 B2
(45) Date of Patent: May 7, 2019

(54) STEAM ATOMIZING LIQUID SPRAY NOZZLE ASSEMBLY

(71) Applicant: Spraying Systems Co., Wheaton, IL (US)

(72) Inventor: Bandish Patel, Carol Stream, IL (US)

(73) Assignee: Spraying Systems Co., Wheaton, IL (US)

( * ) Notice: Subject to any disclaimer, the term of this patent is extended or adjusted under 35 U.S.C. 154(b) by 119 days.

(21) Appl. No.: 15/215,064

(22) Filed: Jul. 20, 2016

(65) Prior Publication Data

US 2017/0021373 A1 Jan. 26, 2017

Related U.S. Application Data

(60) Provisional application No. 62/194,484, filed on Jul. 20, 2015.

(51) Int. Cl.
*B05B 7/08* (2006.01)
*B05B 7/04* (2006.01)

(52) U.S. Cl.
CPC ..... *B05B 7/0416* (2013.01); *B05B 7/04* (2013.01); *B05B 7/0441* (2013.01); *B05B 7/0466* (2013.01); *B05B 7/0475* (2013.01); *B05B 7/0892* (2013.01)

(58) Field of Classification Search
CPC ..... B05B 7/04; B05B 7/0416; B05B 7/0433; B05B 7/0441; B05B 7/0466; B05B 7/045; B05B 7/0458
USPC ..... 239/425
See application file for complete search history.

(56) References Cited

U.S. PATENT DOCUMENTS 4,674,682 A 6/1987 Hansson
6,322,003 B1 * 11/2001 Haruch ..... B05B 7/0458 239/290
6,338,439 B1 1/2002 Goenka et al.
2008/0265062 A1 * 10/2008 Brown ..... B05B 7/0466 239/429

(Continued)

FOREIGN PATENT DOCUMENTS

CN 101982244 B 6/2013
JP 2002-66393 A 3/2002

OTHER PUBLICATIONS

International Search Report dated Oct. 4, 2016, in International Patent Application No. PCT/US2016/043138.

*Primary Examiner* — Alexander M Valvis
(74) *Attorney, Agent, or Firm* — Leydig, Voit & Mayer, Ltd.

(57) ABSTRACT

A steam atomizing liquid spraying system which in the preferred embodiment includes a spray nozzle assembly having a central liquid passageway for coupling to a liquid supply and a plurality of spray nozzles each removably mounted in the nozzle body and having a respective central steam passage communicating with a steam supply. The spray nozzles each further have a plurality of circumferentially spaced liquid accelerating passages that communicate with a respective angled passage of the nozzle body which in turn communicates with the central liquid supply passageway for directing liquid into the central steam passage of the spray nozzle for interaction with steam directed through the central steam passage and atomization of liquid discharging from the spray nozzle. In an alternative embodiment, a single spray nozzle insert is utilized.

9 Claims, 7 Drawing Sheets

(56) References Cited

U.S. PATENT DOCUMENTS

| | | | | |
|---|---|---|---|---|
| 2011/0079664 | A1 | 4/2011 | Stednitz | |
| 2014/0110504 | A1* | 4/2014 | Honeyands | B05B 7/10<br>239/418 |

* cited by examiner

STEAM ATOMIZING LIQUID SPRAY NOZZLE ASSEMBLY

CROSS-REFERENCE TO RELATED APPLICATION

This patent application claims the benefit of U.S. Provisional Patent Application No. 62/194,484, filed Jul. 20, 2015, which is incorporated by reference.

FIELD OF THE INVENTION

The present invention relates generally to liquid spray nozzle assemblies, and more particularly, to spray nozzle assemblies that utilize steam to facilitate liquid atomization, hereinafter referred to as steam atomizing liquid spray nozzle assemblies.

BACKGROUND OF THE INVENTION

Steam atomizing liquid spray nozzle assemblies are used for a variety of spray applications including process gas cooling, gas scrubbing, moisturizing, and de-super heating. Such uses encompass a wide spectrum of processing industries, including aluminum, cement, chemical, petro-chem., steel, power generation, pulp and paper. Since such industries commonly utilize steam during their normal processing, steam is economically available for liquid spray atomization without the need for expensive air compressors and their costly operation and maintenance necessary in pressurized air atomization of sprayed liquids.

Many variables, however, can adversely affect spray performance in steam atomizing spray nozzles. Since most applications demand consistent, very fine liquid particle spraying, a number of conditions can affect the spray discharge. Water temperature, cooling or condensation of the steam, a change in the liquid flow rate, and wear to discharge orifices all can affect the consistency and droplet size of the spray. Wear and other maintenance of the spray nozzles also can cause costly repair and/or replacement of the entire spray nozzle assembly.

OBJECTS AND SUMMARY OF THE INVENTION

It is an object of the present invention to provide a steam atomizing liquid spray nozzle assembly adapted for more efficient and cost effective generation of fine liquid particle sprays with a controlled droplet size for precise and efficient gas cooling, gas scrubbing, and other applications.

Another object is to provide a steam atomizing liquid spray nozzle assembly as characterized above that eliminates steam condensation prior to atomization of liquid during spraying that can interfere with droplet size consistency and spray performance.

A further object is to provide a steam atomizing liquid spray nozzle assembly of such type in which the droplet size of the spray distribution remain constant over a wider temperature range of the sprayed liquid.

Yet another object is to provide a steam atomizing liquid spray nozzle assembly of the above kind which lends itself to simple modification for accommodating required changes in processing.

Still another object is to provide a steam atomizing spray nozzle assembly of the foregoing type that is relatively simple in construction and lends itself to fast, easy, and economical maintenance.

Other objects and advantages of the invention will become apparent upon reading the following detailed description and upon reference to the drawings.

Figure 1:
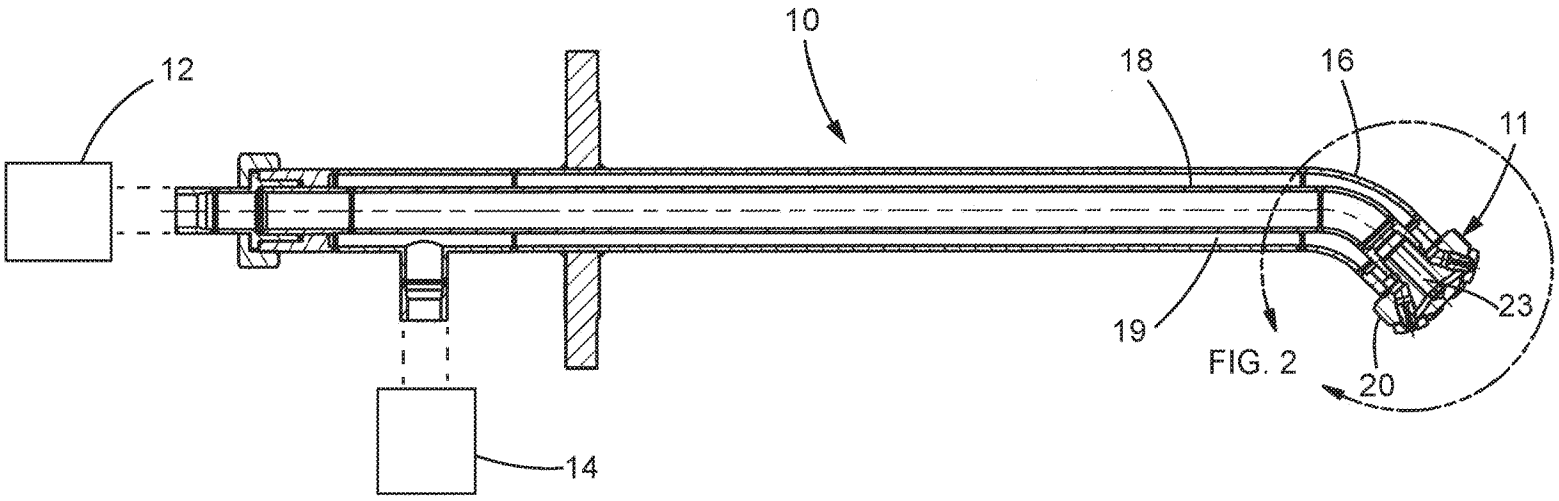
FIG. 1 is a vertical section of an illustrative spraying system having a steam atomizing liquid spray nozzle assembly in accordance with the invention.
Figure 2:
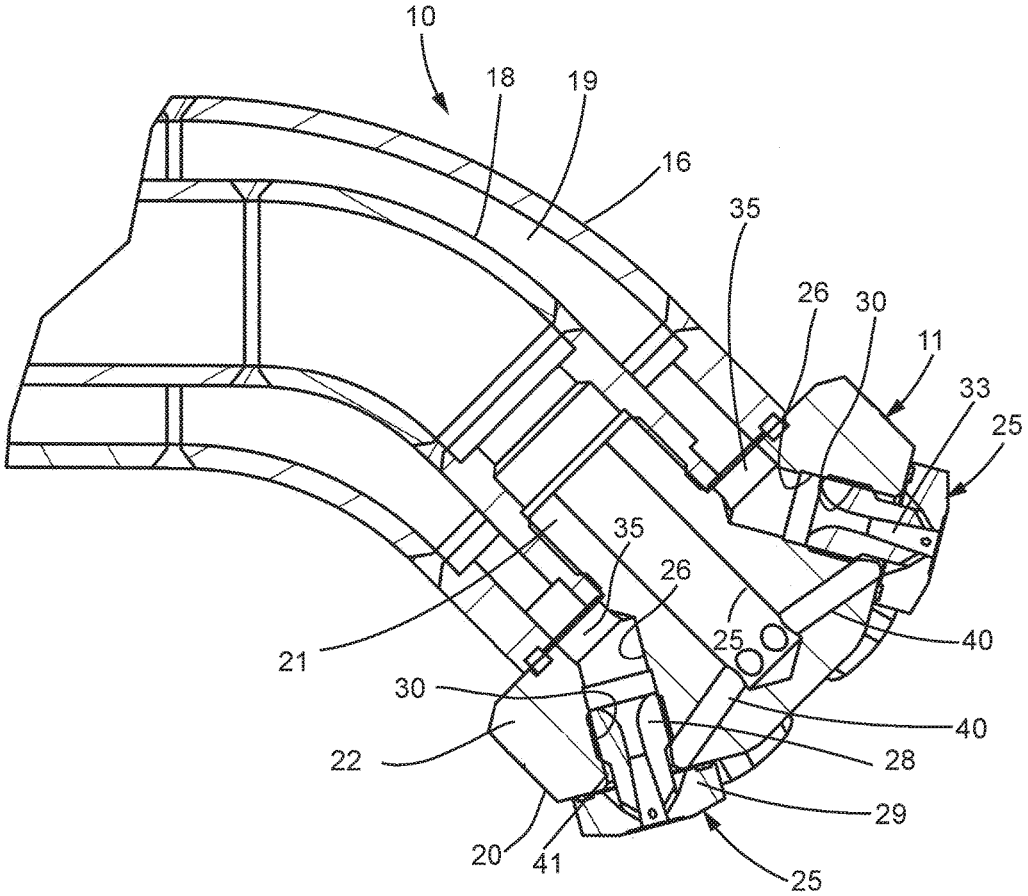
FIG. 2 is an enlarged vertical section of the discharge end of the illustrated spray nozzle system depicted in claim 1.
Figure 3:
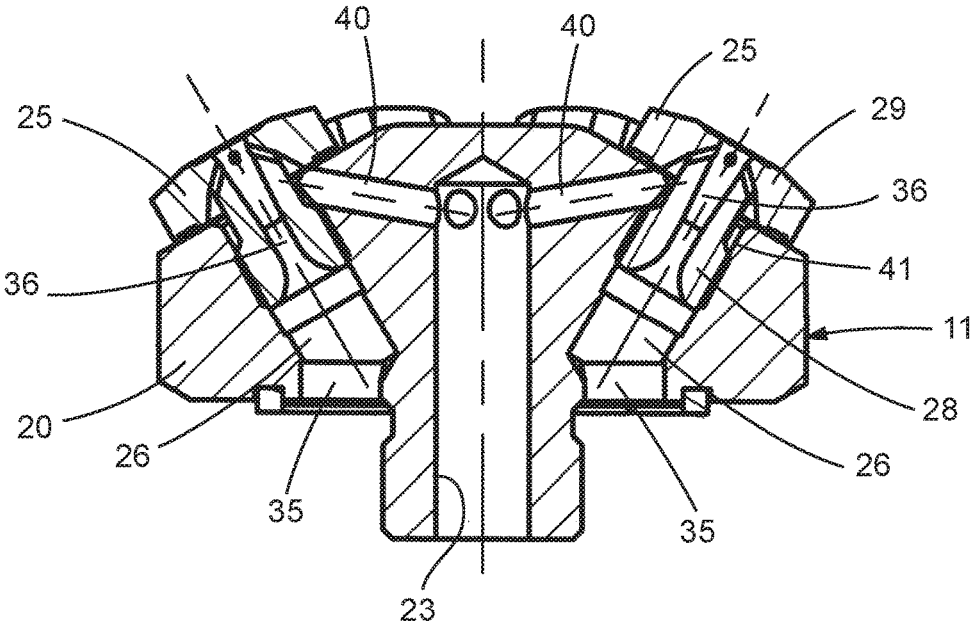
FIG. 3 is a longitudinal section of the illustrative spray nozzle assembly.
Figure 4:
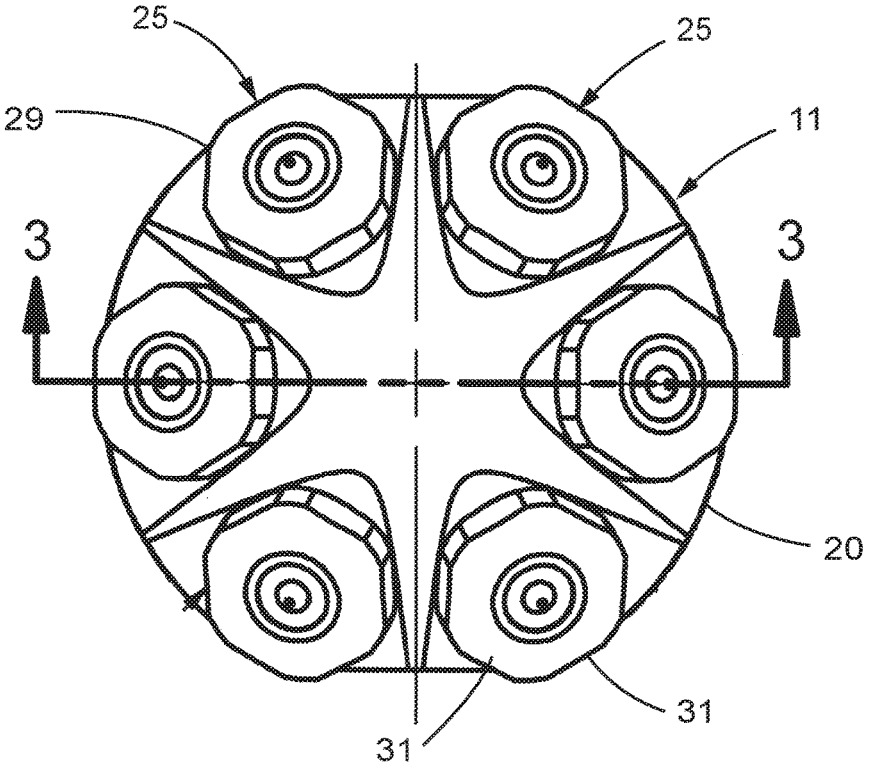
FIG. 4 is an end view of the spray nozzle assembly shown in FIG. 3.
Figure 5:
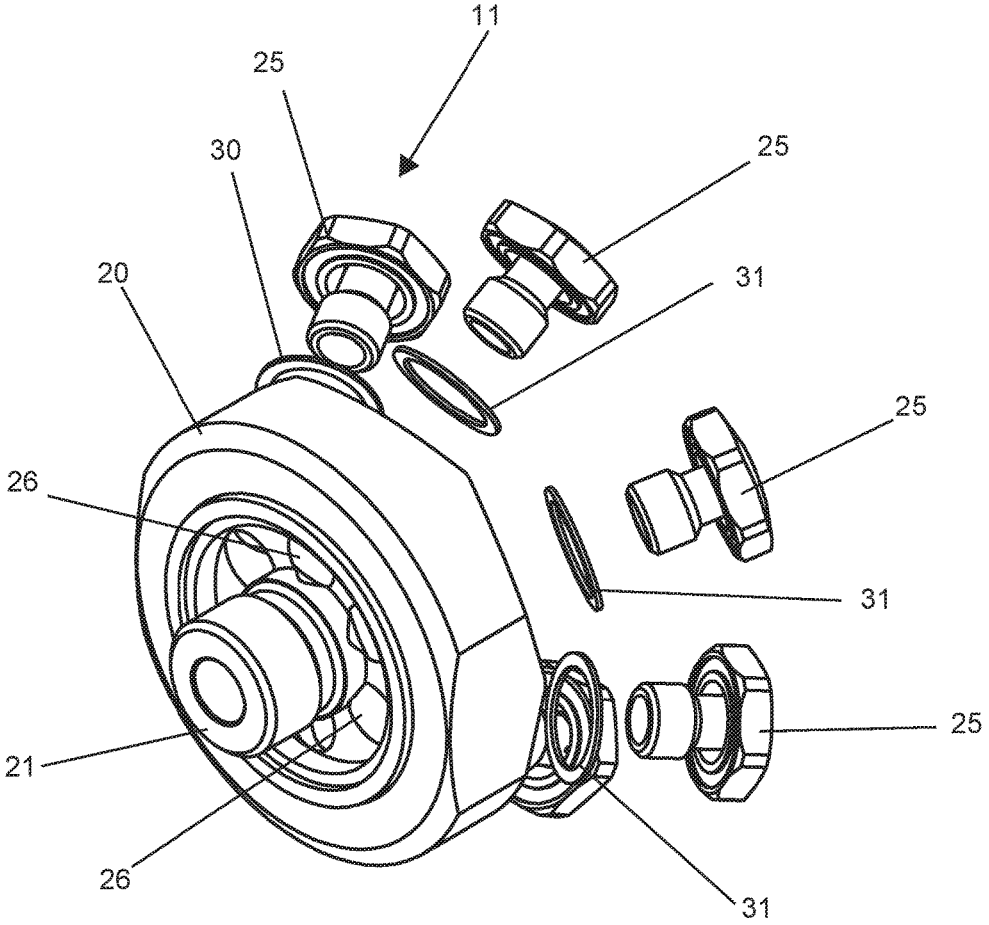
FIG. 5 is an exploded perspective of the illustrated spray nozzle assembly.
Figure 6:
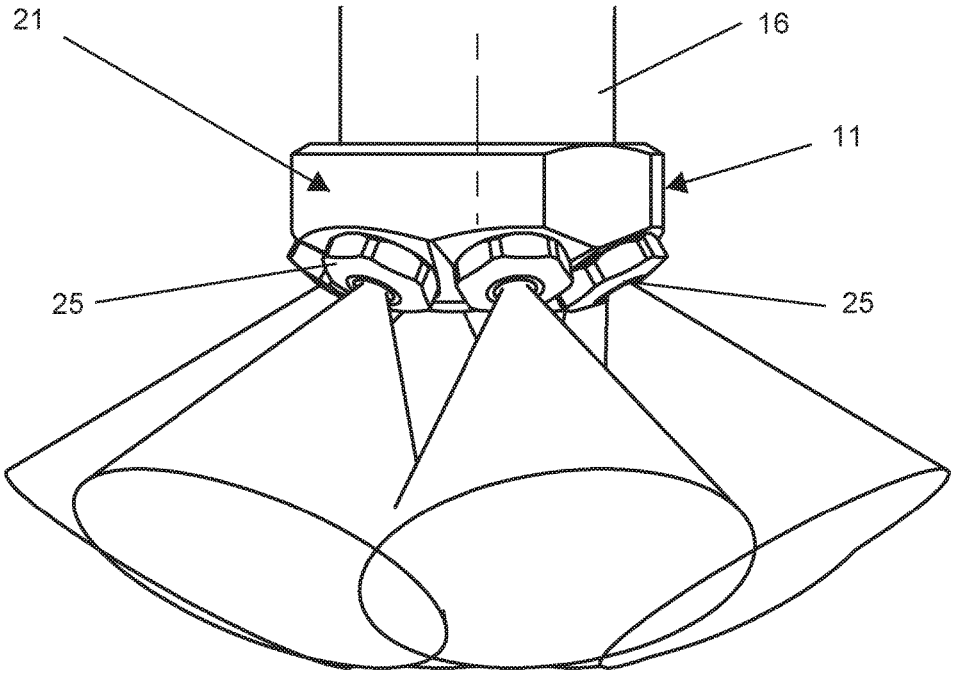
FIG. 6 is a side elevational view of the spray nozzle assembly shown discharging a full cone conical spray pattern of finely atomized liquid particles.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Referring now more particularly to the drawings, there is shown an illustrative spraying system 10 having a steam atomizing liquid spray nozzle assembly 11 in accordance with the invention. The spraying system 10 includes a liquid supply 12, such as water or a slurry, and a steam supply 14. It will be understood that the steam supply 14 may be an existing steam supply in the plant or other facility utilizing the spraying system.

The spray nozzle assembly 11 in this case is mounted on a cylindrical injector 16 having a central liquid feed tube 18 communicating with the liquid supply 12 and an annular steam passageway 19 surrounding the feed tube 18 communicating with the steam supply 14. The illustrated spray nozzle assembly 11 includes a nozzle body 20 having an upstream externally threaded hub 21 screwed into a downstream end of the injector liquid feed tube 18, and an enlarged diameter annular nozzle support 22 mounted adjacent a downstream end of the injector 16. The nozzle body 20 is formed with a central liquid passage 23 communicating with the liquid feed tube 18.

In accordance with an important feature of the present embodiment, the spray nozzle assembly 11 includes a plurality of nozzle inserts 25 designed for providing optimum desired steam atomization of spray discharges from the respective nozzle inserts 25. The nozzle inserts 25 are mounted in respective passageways 26 of the nozzle body 20 which in this case are oriented outwardly with respect to a central axis of the spray nozzle assembly 11 at an angle of about 30 degrees. The illustrated nozzle assembly 11 has six circumferentially spaced nozzle inserts 25, although it will be understood by one skilled in the art that greater or lesser numbers of nozzle inserts could be used for particular spray applications.

The illustrated nozzle inserts 25 each comprise an upstream externally threaded stem 28 and an enlarged diameter downstream head 29. The nozzle inserts 25 are removable mountable in the nozzle body 20 by screwing the nozzle insert stems 28 into respective threaded sections 30 of the nozzle body passageways 26. The sealing o-ring 31, such as made of copper or stainless steel, is disposed in surrounding relation to the stem 28 in interposed relation between an upstream end face of the nozzle insert head 29 and the downstream end of the nozzle body 20. The nozzle insert heads 29 in this instance each are formed with hex configured flats 31 for facilitating mounting and removal of the nozzle inserts 25 by a simple wrench, and the upstream end face of the head 29 is formed with an annular sealing ring receiving recess 32 having an axial depth less than the thickness of the sealing ring 31.

Figure 7:
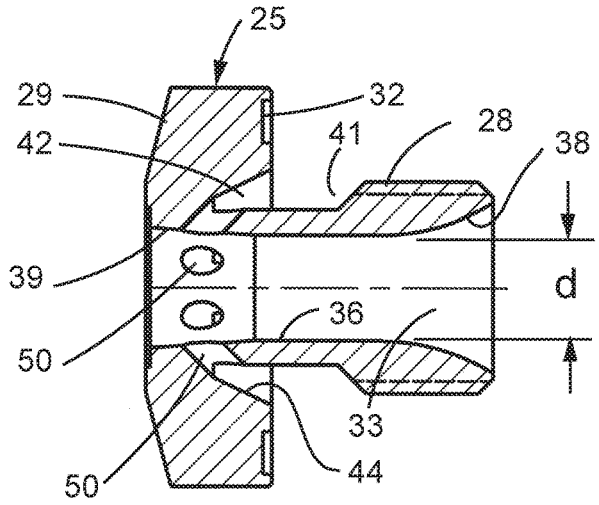
FIG. 7 is an enlarged vertical section of one of the nozzle inserts of the spray nozzle assembly show in FIGS. 1-6.

The nozzle body passageways 26 each have a respective steam inlet 35 communicating with the annular manifolds steam passageway 19 of the injector 16. The nozzle inserts 25 each have a central steam passageway 33 which includes a nozzling passage section 36 of a predetermined diameter "d" for accelerating steam for optimum liquid atomization, as will become apparent, an inwardly curved inlet section 38 communicating between the nozzling section 36 and steam inlet 35, and an outwardly tapered conical discharge section 39 opening at a small conical angle of about 4 degrees with respect to the longitudinal axis of the steam passage (FIG. 7).

For directing liquid to the nozzle inserts 25, the nozzle body 20 has an angled passage system defined by a plurality of angled passageways 40 communicating between the central liquid passage 23 and a respective annular manifold passage 41 of each nozzle insert 25 defined between a reduced diameter portion of the nozzle insert stem 21 and of the body passageway 26 within which the nozzle insert 25 is mounted. In this case, the liquid manifold passage 41 of each nozzle insert 25 is disposed immediately upstream of the nozzle insert head 29 and includes a pocket or recess 42 (FIG. 7) extending into an upstream side of the head 29. The recess 42 in this instance is generally triangular in shape defined by an extension of the recess and an outer conical wall 44 within the head 29.

In carrying out a further aspect of this embodiment, the nozzle inserts 25 each are formed with a plurality of circumferentially spaced angled liquid accelerating passages 50 that communicate between the liquid manifold passage 41 of the nozzle insert 25 and the central steam passageway 33. The angled liquid passages 50 each are dimensioned for accelerating the liquid immediately prior to interaction with steam directed through the steam passageway 33. In the embodiment shown in FIG. 7 the nozzle inserts 25 each are formed with six angled liquid passages 50 extending at an angle of about 45 degrees to the central axis of the nozzle insert 25 in a respective radial plane through the central axis.

In further carrying out this feature of the embodiment, the angled liquid passages 50 communicate with the central steam passage 33 immediately adjacent downstream end of the steam passage 33 for enhancing optimum atomization of the plurality of accelerated liquid flow streams simultaneously upon their discharge from the nozzle insert 25. To facilitate proper direction of the discharging liquid from the plurality of the angled liquid passages 50 of the nozzle insert 25, the angled liquid passages 50 in this instance communicate with a downstream end of the pocket or recess 42 of the manifold passage 41. Since the liquid and steam flow streams interact immediately adjacent a downstream end of the central steam passageway 33, it has been found that he steam will interact and atomize the liquid with maximum effectiveness and without cooling, condensation, or loss of energy of the steam that can occur by contacting with the lower temperature liquid upstream in the steam passage 33. Accordingly, it has been found that the nozzle inserts 25 are effective for optimally atomizing the spray discharge over a wide range of temperatures, such as between about 70 and 200 degrees Fahrenheit, of the liquid being sprayed.

In accordance with still a further feature of this embodiment, the spray nozzle assembly 11 is adapted for easy modification for spraying with a wide variation of liquid flow rates for particular applications. For example, the nozzle assembly 11 having nozzle inserts 25 shown in FIG. 7 has been found effective for spraying controlled finely atomized liquid at a rate of about 25 gallons per minute. The nozzle inserts 25 each have a central steam passage 33 with a nozzling section 36 having a diameter d of 0.249 inches and six circumferentially spaced angled liquid accelerating and directing passages 50 having a diameter of 0.073 inches.

Figure 8:
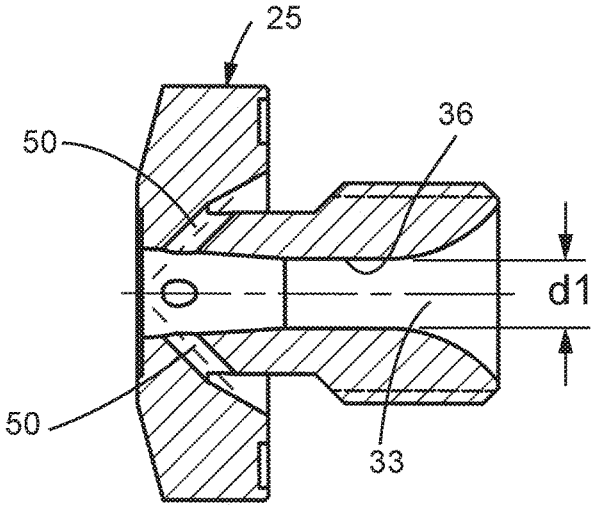
FIG. 8 is an alternative embodiment of the spray nozzle insert usable the subject spray nozzle assembly.
Figure 9:
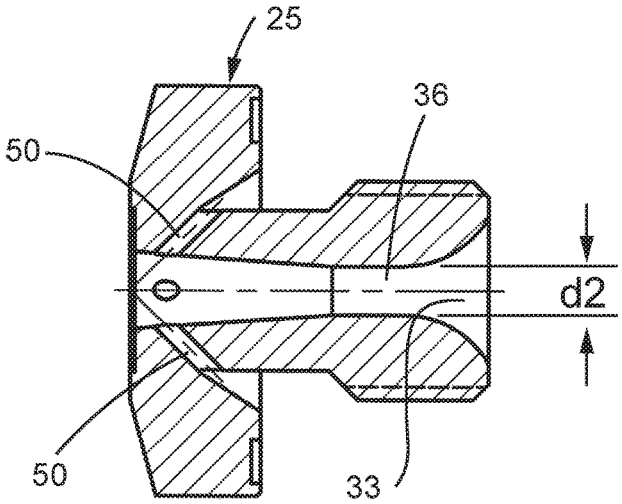
FIG. 9 is a further alternative embodiment of the nozzle insert usable with the subject spray nozzle assembly.

In keeping with the invention, the flow rate of the nozzle assembly 11 may be easily modified by simply changing the nozzle inserts 25. For example, using the nozzle inserts, as shown in FIG. 8, the spray nozzle assembly 11 may direct finely atomized liquid at a lower flow rate of about ten gallons per minute. The nozzle inserts 25 in this case have a central steam passage section 33 with a nozzling section 36 having a diameter d1 of 0.157 inches and four liquid directing and accelerating liquid passages having a diameter of 0.059 inches. Utilizing nozzle inserts 25, as shown in FIG. 9, the spray nozzle assembly 11 can be easily modified to spray at still a lower flow rate of about 5 gallons per minute. In this case, the nozzle inserts 25 have a central steam nozzling section having a diameter d2 of 0.111 inches, and the four angled liquid accelerating and liquid directing passages 50 having a diameter of 0.042 inches. Hence it can be seen that nozzle inserts 25 with various sized steam and liquid passages 33 and 50 may be utilized to achieve a particular spray performance. Preferably, for optimum performance, the ratio of the area of the cross section of the steam passageway nozzle section 36 to the total cross sectional areas of the liquid passages 50 should be between about 1.7 and 2.0.

Figure 10:
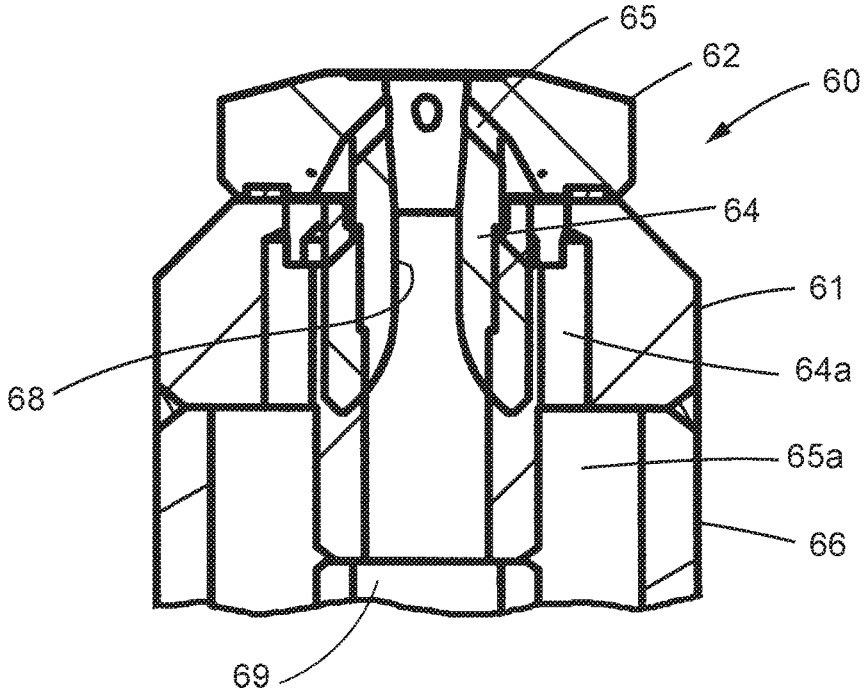
FIG. 10 is a longitudinal section of an alternative embodiment of a spray nozzle assembly in accordance with the invention that utilizes a single nozzle insert.

For spraying at even lower flow rates, a single nozzle insert embodiment spray nozzle assembly 60 may be utilized, as shown in FIG. 10. In this case, the nozzle assembly 60 has a nozzle body 61 that is annular configured for axially supporting a single nozzle insert 62 having a stem 64 screwed into a central threaded section of the nozzle body 61, which in turn defines an annular liquid passage **64*a* communicating with angled liquid directing and accelerating passages 65 of the nozzle insert 62. The annular liquid passage 64*a* in this case communicates with an outer liquid passage 65*a* of an injector 66. The nozzle insert 62 has a central steam passage 68 that communicates with a central steam passage 69 of the injector 66. Since a single nozzle insert 62** is utilized, a substantially smaller liquid feed rate, such as about one gallon per minute, can be sprayed with a controlled fine liquid particle spray distribution.

Not only is the spray nozzle assembly of the subject invention adapted for easy modification for particular spray applications, it will be understood that it similarly is adapted for easy repair, such as due to nozzle wear, by simple replacement of the nozzle inserts. The nozzle inserts, furthermore, can be made of a different material than the nozzle body for enhanced wear resistant to slurries and other abrasive liquids with which the spray nozzle assembly might be used. Since only three basic components are involved, namely the nozzle body, the nozzle inserts, and the gaskets, and no special tools are required for installation or maintenance.

From the foregoing, it can be seen that a steam atomizing liquid spray nozzle assembly is provided that is adapted for more efficient and cost effective generation of fine liquid particle sprays with a control droplet size for gas cooling, gas scrubbing, and many other applications. The spray nozzle assembly facilitates efficient atomization by eliminating steam condensation during spraying that can interfere with droplet size consistency and spray performance. The droplet size and spray distribution further remains constant over a wide temperature range of the sprayed liquid. The spray nozzle assembly further is relatively simple in construction, and lends itself to simple modification for accommodating changes in processing conditions, as well as easy maintenance.

The invention claimed is:

1. A steam atomizing liquid spraying system comprising:

a spray nozzle assembly including a nozzle body having a central liquid passageway for coupling to a liquid supply;

a plurality of spray nozzles each removably mounted in a respective nozzle receiving passage of said nozzle body;

said nozzle receiving passages of said nozzle body each being coupleable to a steam supply;

said plurality of spray nozzles each having a central steam passage extending axially through the spray nozzle communicating between the respective nozzle receiving passage and a discharge orifice of the respective spray nozzle for directing steam from the steam supply axially through the spray nozzle for discharge from the discharge orifice thereof;

said plurality of spray nozzles each having a plurality of angled liquid passages disposed circumferentially about the respective spray nozzle communicating with the central steam passage thereof, and said nozzle body and each of said plurality of spray nozzles defining an annular manifold chamber about the respective spray nozzle; and said nozzle body having an angled passage system communicating between said central liquid passage and the annular manifold defined between the nozzle body and each of the plurality spray nozzles for communicating liquid directed through the central liquid passage to each respective annular manifold chamber and in turn through angled liquid passages of the plurality of spray nozzles for interaction with steam directed through the central steam passage of the respective spray nozzle for atomizating liquid discharging from the spray nozzle assembly via the discharge orifices of the plurality of spray nozzles.

2. The steam atomizing liquid spraying system of claim 1 in which said angled passages of each of the plurality of spray nozzles are sized for accelerating the passage of liquid.

3. The steam atomizing liquid spraying system of claim 2 in which the plurality of angled liquid passages of each of the plurality of spray nozzles communicate with the central steam passage of the respective spray nozzle adjacent a downstream end of the central steam passage of the spray nozzle.

4. The steam atomizing liquid spraying system of claim 1 in which each of the plurality of spray nozzles includes an upstream externally threaded stem for threaded engagement with said nozzle body and an enlarged diameter head mounted externally of the nozzle body, and said annular manifold passage is formed at least in part within the head of the spray nozzle.

5. The steam atomizing liquid spraying system of claim 1 in which said central steam passage of each of the plurality of spray nozzles has a reduced diameter section for accelerating the passage of steam through the central steam passage prior to interaction with liquid directed into the central steam passage of the respective spray nozzle.

6. The steam atomizing liquid spraying system of claim 1 including an injector for supporting the spray nozzle assembly, said injector comprising an internal liquid feed tube communicating between the liquid supply and the central liquid passageway of the nozzle body and an outer tube defining an annular steam passage between the outer tube and inner tube communicating between the steam supply and each of the spray nozzle receiving passages.

7. The steam atomizing liquid spraying system of claim 2 in which the angled liquid passages of each of the plurality of spray nozzles communicate with the central steam passage of the respective spray nozzle at an acute angle to a longitudinal axis of the central steam passage.

8. The steam atomizing liquid spraying system of claim 7 in which the ratio of the cross section of the central stem passage of each of the plurality of spray nozzles to the total cross-sectional areas of the angled liquid passages of the respective spray nozzle is between about 1.7 and 2.0.

9. The steam atomizing liquid spraying system of claim 1 in which said nozzle body angled passage system comprises a plurality of circumferentially spaced passages through said nozzle body each communicating between said central liquid passage and a respective one of said annular manifold chambers defined between the nozzle body and said plurality of spray nozzles.

* * * * *